United States Patent [19]

Groeneveld

[11] 3,964,854

[45] June 22, 1976

[54] DEVICE FOR FINISHING TILE JOINTS

[76] Inventor: Johannes Groeneveld, Varrentrappstrasse 51, D-6 Frankfurt am Main, Germany

[22] Filed: June 6, 1974

[21] Appl. No.: 477,314

[30] Foreign Application Priority Data

June 8, 1973 Germany ..... 2329312

[52] U.S. Cl. ..... 425/458; 15/235.3; 425/87

[51] Int. Cl.[2] ..... B29C 23/00; B29F 3/012; E04G 21/20

[58] Field of Search ..... 425/458, 87; 15/235.3, 15/235.4, 235.5, 235.6, 235.7, 236 R, 236 NO; 30/169, 171; 403/327, 328

[56] References Cited

UNITED STATES PATENTS

| | | | |
|---|---|---|---|
| 1,262,018 | 4/1918 | Collins | 15/235.3 |
| 1,572,142 | 2/1926 | Hood | 403/328 X |
| 2,259,662 | 10/1941 | Roberts | 30/171 |
| 2,331,732 | 10/1943 | Ryzmek | 15/236 X |
| 3,087,654 | 4/1963 | Moore | 425/458 X |
| 3,109,193 | 11/1963 | Erickson | 425/458 X |
| 3,230,566 | 1/1966 | Moody | 15/235.3 |
| 3,389,420 | 6/1968 | Pryor | 15/235.3 |
| 3,403,419 | 10/1968 | Hazelrigg | 15/235.3 |
| 3,698.748 | 10/1972 | Petri | 403/328 |
| 3,846,060 | 11/1974 | Otis | 425/458 |

*Primary Examiner*—Francis S. Husar
*Assistant Examiner*—John S. Brown
*Attorney, Agent, or Firm*—Lilling & Siegel

[57] ABSTRACT

There is disclosed a device for finishing joints between tegular elements applied to a surface. The device consists of a support and at least one head the support being suitable for gripping by the hand and the head being specially shaped to enable the jointing material between the adjacent elements to be finished formed. The head is shaped so that when the device is applied to the adjoining edges of adjacent tegular elements it makes limited contact with the adjoining edges of the elements and has a constantly diminishing transverse dimension in at least one direction along the joint. The head together with the jointing material fully occupies the space between the elements between the regions of contact and if the device is moved along the joint in the direction of the diminishing dimension of the head a smooth and regular surface contour of the jointing material between the edges of the elements is achieved. It is disclosed that the head may be separable from the support or may be integral with it and that the head at its operative end may take the various different forms. Also disclosed is the method of using the device described hereinbefore.

18 Claims, 5 Drawing Figures

DEVICE FOR FINISHING TILE JOINTS

This invention concerns a device for and a method of finishing the surface of a jointing material between tegular elements applied to a surface.

For the construction of tegular surfaces and in particular tiled floors or walls in dwelling areas such as kitchens bathrooms or the like, current practice is that, after application of the tiles to the floor or wall surface, a jointing material or mortar in a relatively liquid form is applied over the tiled surface and between the tiles through to the material by which the tiles are held to the surface. That is to say joints are formed by the jointing material but also the visible surfaces of the tiles are covered with a relatively thin layer of the jointing material. Sufficient time is then allowed to pass to enable the jointing material to dry on the tiled surfaces. The jointing material forming the actual joints, and in the immediate vicinity thereof, is subsequently washed and at the same time the greater part of the residual jointing material on the tile surfaces is removed. The entire tiled surface is then rubbed down with fine steel wool or some other cleaning agent which removes any residual jointing material remaining on the tile surfaces, this particular step being termed, by those skilled in the art, polishing.

This process, which is in general use, has some substantial disadvantages. On the one hand, washing or rinsing of the tiles after the introduction of the jointing material to form the joints and drying of the jointing material is not only time consuming and frequently even a difficult operation, but it is all the more unpopular because it involves considerable discomfort and health hazard. Apart from the very considerable water consumption involved, it is quite inevitable in practice, during this operation, for the tiles to become soaked with the rinse water. This can be the cause of undesirable illness, such as colds, inflammation of the kidneys or rheumatic complaints, not only in winter or areas with a harsh climate. Furthermore, as has been proved, this method of operation is never really practicable when the ambient temperature is below the freezing point of water, as is frequently the case in Central Europe, for example. This means that, particularly in the building trade, tiling operations cannot be carried out in winter in such places.

There is the further disadvantage that it has, in practice, proved impossible, even for an experienced and skilled tile layer, to obtain a generally uniform joint surface by means of a washing or rinsing operation carried out with a sponge. The problems associated with this become all the greater when the joint width is irregular from tile to tile, that is to say, the more the joint width varies, over the length of the joint, between adjacent tiles, or the more irregularly the tiles are laid, so far as the projection of their visible surfaces from the floor or wall surface is concerned. When laying tiles it is in fact inevitable that certain discrepancies occur from tile to tile so far as the joint width or visible tile surfaces are concerned. This being so, when the liquid jointing material originally introduced is removed by washing or rinsing of the tiled surface, experience has shown that irregularities of joint depth result. These frequently assume the form of crevices or eroded areas, without the actual joint being generally damaged with regard to the volume of jointing material which forms it. Although the unattractive external appearance of the joint has nothing to do with the adhesion of the tiles on the surface or with the water tightness of the tiled surface, it frequently leads to customer complaints, rendering corrective work necessary with consequent increased costs.

The present invention is directed to remedying the above mentioned inconveniences and to providing for the possibility of eliminating the disadvantages of the currently conventional process of washing or rinsing the tegular surface after the liquid jointing material has dried, and to providing means by which joints can be completed simply and economically regardless of the width of the joint between adjacent tiles or the projection of the tiles from the surface, which joints in practice have an external profile which is constant and regular over their entire length and have a surface which for all intents and purposes is free of crevices and holes, and finally to ensuring at the same time that a tiling operation can be carried out at ambient temperatures below the freezing point of water, that is to say, in frosty weather and regions.

According to the present invention, a device for finishing the surface of a jointing material between tegular elements applied to a surface comprises a head, and a support therefor adapted to be gripped by hand for manipulation of the device, the terminal shape of said head being such that it can be brought into operational engagement with the adjoining edges of adjacent tegular elements defining a joint with limited contact at each said edge and with a continually diminishing transverse dimension from the contact regions in at least one direction along said joint at least in the vicinity of said contact regions and, together with the jointing material, occupying at said contact regions the whole space between said adjoining edges of said adjacent tegular elements.

The device is utilised in the manner now to be described. After the liquid jointing material has dried the device is applied, extending substantially vertically relative to the visible surfaces of two tiles defining a joint, onto the joint filled with jointing material such as mortar and is drawn along the edges of the tiles defining the joint, with slight pressure applied in a direction normal to the surface of the joint and the visible surfaces of the tiles. The head of the device thereby presses into the jointing material which is still slightly wet and removes therefrom a precisely defined amount of the jointing material forming the joint with a scraping action. Suprisingly a single scraping stroke, that is to say, a single passage of the device according to the invention along the tile edges which define the joint proves sufficient. Thereby the joint is always given a surface which in practice is uniform and free of crevices and holes over its entire length, that is to say, across a plurality of tiles, the shape of the surface corresponding to the contour of the head. This is achieved without the use of water, independently of the width of the joint, and independently of the extent to which the tiles defining the joint project from the floor or wall surface, this being particularly so because the head is always guided on the adjoining edges of adjacent tiles with limited contact and has an operative portion which is curved towards the direction of movement and regardless of whether the tile edges are sharp or rounded. Surprisingly, fracturing of the jointing material and flaws in the joint surface are consistently prevented by the use of the device. Health risks and also the extremely high costs arising in consequence of complaints owing to the unattractive appearance of the joints are both eliminated. Particularly low production costs are achieved if the device support and the head of the device, or both, are made of synthetic material.

The invention will now be described further, by way of example only and in greater detail with reference to certain preferred embodiments thereof, with reference to the accompanying drawings in which.

Figure 1:
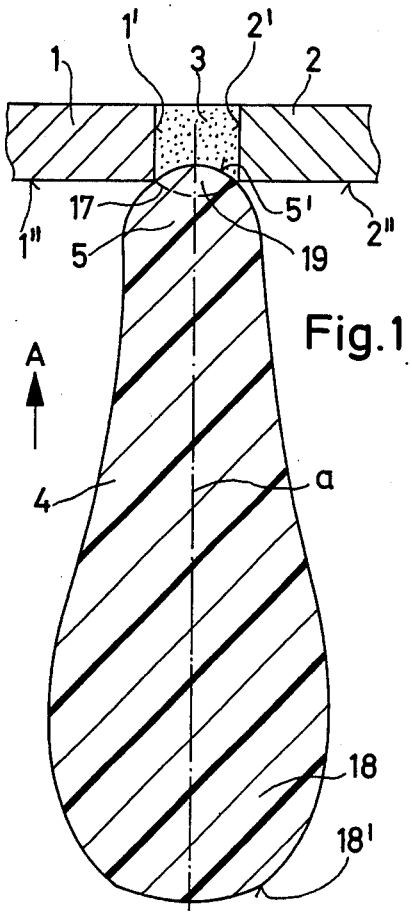
FIG. 1 is a diagrammatic illustration in the form of a sectional elevation of one device constructed according to the invention in operational use on a tiled surface.

Referring to FIG. 1 a joint 3 of mortar material 19 if formed between two tiles 1, 2, the marginal regions only of which are shown. After the liquid mortar material has been applied and has dried the material forming the joint has a surface form projecting beyond the visible surfaces 1'', 2'', of the tiles 1, 2, this being indicated by the dashed line 17. This cross sectional peak must be removed in a suitable manner during finishing of the tiled surface. This is achieved by means of a device constructed according to the invention, comprising a hand grip 4 and scraper head 5, 5*a*, 5*b*, 5*c*, 5*d* which latter is applied to the joint 3 and drawn along the edges of the opposite tile surfaces 1', 2', defining the joint region with point contact and whilst applying slight pressure in the direction of the arrow A. A single stroke of the contoured part 5', 5*a*', 5*b*', 5*c*', 5*c*'', 5*d*'', of the scraper head 5, 5*a*, 5*b*, 5*c*, 5*d*, removes such an amount as the jointing material 19 that the surface of the joint assumes a contour which is complementary to the scraping contour of the head.

It is clear that the joint surface contour is produced in such a manner that it will have a practically identical external appearance even when the visible surfaces 1'', 2'', of the two tiles 1, 2, are not aligned with each other or when the interval between the tile surfaces 1', 2', defining the joint width varies in magnitude.

In the embodiment shown in FIG. 1, the device is of integral construction, two scraper heads of different sizes and having different radii of curvature being provided, one at each end. The hand grip is designated by the reference numeral 4, the smaller scraper head, having a hemispherical contour, and formed at one end of the grip 4, by the reference numeral 5, and the other scraper head formed by the opposite end of the hand grip by the reference numeral 18 and its curved scraping contour by the reference numeral 18'. This one-piece device is formed as a solid of revolution about the central longitudinal axis *a*, has a cross sectional shape as illustrated, and is made of synthetic material.

Figure 2:
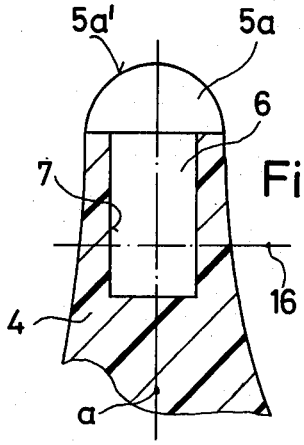
FIG. 2 is a similar illustration of the head end of another embodiment of the invention.

In the embodiment of FIG. 2 the grip 4 is so constructed that different scraper heads can be inserted at one end. For this purpose the one end of the grip 4 is provided with a blind hole 7, whilst the scraper heads 5*a*, 5*c*, 5*d* which can be fitted thereto, each comprise a shaft 6 adapted for insertion in the recess 7 in the grip 4 and have suitably contoured operative ends. In this embodiment the mushroom shaped scraper head 5*a* has a hemispherical operative contour 5*a*'. The heads may be held in position by means of a pin passing through aligned holes in the grip 4 and the shaft 6 indicated by the line 16.

Figure 5:
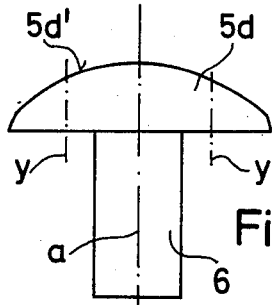

The head 5*d*, 6, illustrated in FIG. 5 has a mushroom shaped head 5*d* but the operative contour 5*d*' is different. The scraper heads according to FIGS. 2 and 5 are interchangeable according to the required joint surface contour.

Figure 3:
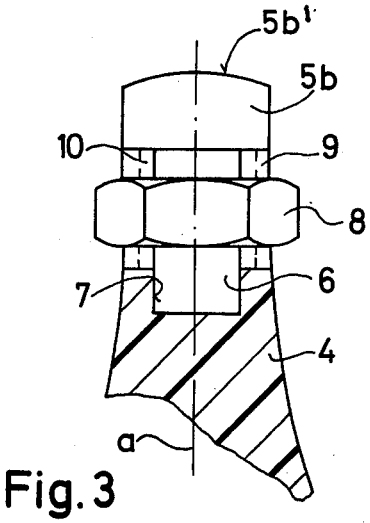
FIG. 3 is a similar illustration of the head end of yet a further embodiment of the invention.

The embodiment illustrated in FIG. 3 includes a scraper head similar to that shown in FIG. 2 but is held in place in the grip 4 by virtue of an alternative construction involving a known screw threaded clamp mounting such as is known in connection with small hand tools. For this purpose the receiving end of the grip is provided with an external screw thread 9 and a number of slits 10 opening into the recess 7 for the scraper head shaft 6, by virtue of which slits a reduced thickness of the material of the grip 4 is left between each adjacent pair of slits 10 and each of these is urged against the shaft 6 of the scraper head 5*b* by screwing a nut 8 on the thread 9. In this manner the head is firmly secured to the hand grip 4.

Whereas the scraper heads illustrated in FIG. 1, 2 and 5 of the accompanying drawings are formed as solids of revolution thus enabling them to be used in any desired angled position in relation to their central longitudinal axis *a*, FIG. 3 a scraper head 5*b*, 6, is illustrated which requires to be used in a particular orientation. This scraper head is not formed as a solid of revolution but has a slightly curved contour derived from the mushroomed shaped scraper head 5*d* shown in FIG. 5 by cutting off the lateral end regions substantially along the lines Y—Y. The scraping contour is designated by the reference numeral 5*b*' in this case.

Figure 4:
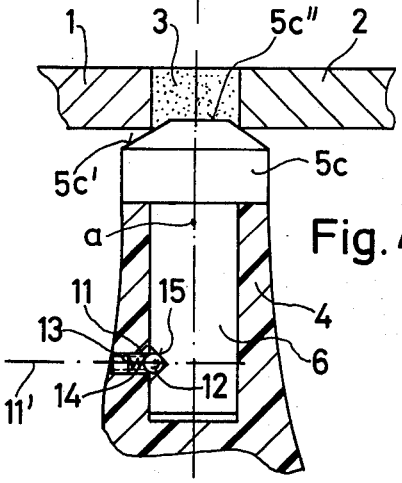
FIG. 4 is a similar view of a still further embodiment of the invention showing the head of the device in operational use, and, FIG. 5 shows yet another form of head alone.

Whereas, in the embodiment illustrated in FIG. 2, the shaft 6 of the scraper head 5*a*, 6, is held in the recess 7 by virtue of its being a precise press fit, FIG. 4 illustrates an alternative possibility for securing the scraper head in position in the hand grip 4. For readily detachable but secure fixing of the scraper head 5*c*, 6, in the recess of the a hand grip 4 a stop ratchet is provided which can be formed by a ball 12 which is held so as to be capable of displacement in a resilient manner in a threaded bore 11 on the axis 11' and can be urged into the threaded bore 11 against the action of a spring 14 supported by a set screw 13, when the leading end of the shaft 6 travels over it, whereupon after reaching the seating for the scraper head 5*c*, 6, in the hand grip 4, the ball 12 engages in a corresponding recess 15 provided in the shaft 6 either in the form of a hole or of an annular groove. Thereby the scraper head is satisfactorily fixed in position.

The head 5*c* of the scraper head 5*c*, 6, is shaped as a truncated cone at its operative end and this has straight line contours 5*c*', 5*c*'', and alike the embodiments of FIG. 1, 2 and 5 does not require any particular attention to its orientation relative to the joint 3 or the tiles 1, 2, defining said joint, before its operative use. Again in this case a complementary surface contour of the joint is attained according to the scraping contour of the scraper head. The differences in end contours will be apparent for example from a comparison of FIGS. 1 and 4.

The invention is not restricted to the preferred embodiments illustrated, since there are diverse possibilities open to those skilled in the art for the adaption of the invention to the particular requirements of any situation by different combinations of features of their replacement by analogous features without departing from the spirit of the invention.

What is claimed is:

1. A scraping and pressing tool or device for finishing the surface of a jointing material between tegular elements applied to a surface and wherein said elements lie in the same plane, comprising a head, and a support therefor adapted to be gripped by hand for manipulation of the device, the terminal shape of said head being hemispherical in form such that it can be brought into operational engagement with the adjoining edges of adjacent tegular elements defining a joint with limited contact at each said edge and with a continually diminishing transverse dimension from the contact regions to the center portion of said head along said joint.

2. A device according to claim 1 in which said head is removably connected to said support.

3. A device according to claim 2 in which said head includes a shaft adapted to be secured in position in a recess in said support.

4. A device according to claim 3 in which said recess is in the form of a blind hole extending from one end of said support.

5. A device according to claim 3 in which said shaft is a close press fit in said recess.

6. A device according to claim 3 further comprising a pin adapted to pass through aligned apertures in said support and said shaft for holding the latter in position.

7. A device according to claim 3 in which said recess is at least partially defined by deformable walls and further comprising means for inwardly deforming said walls when said shaft is in position firmly to grip same.

8. A device according to claim 3 further comprising means resiliently mounted in said support and extending into said recess and at least one formation on said shaft adapted to be engaged by said resiliently mounted means when said head is in position in said support.

9. A device according to claim 1 further comprising a second head, said second head having like characteristics to the first head.

10. A scraping and pressing tool or device for finishing the surface of a jointing material between tegular elements applied to a surface and wherein said elements lie in the same plane, comprising a head, and a support therefor adapted to be gripped by hand for manipulation of the device, the terminal shape of said head being frusto-conical in form such that it can be brought into operational engagement with the adjoining edges of adjacent tegular elements defining a joint with limited contact at each edge and with a continually diminishing transverse dimension from the contact regions to the center portion of said head along said joint.

11. A device according to claim 10 in which said head is removably connected to said support.

12. A device according to claim 11 in which said head includes a shaft adapted to be secured in position in a recess in said support.

13. A device according to claim 12 in which said recess is in the form of a blind hole extending from one end of said support.

14. A device according to claim 12 in which said shaft is a close press fit in said recess.

15. A device according to claim 12 further comprising a pin adapted to pass through aligned apertures in said support and said shaft for holding the latter in position.

16. A device according to claim 12 in which said recess is at least partially defined by deformable walls and further comprising means for inwardly deforming said walls when said shaft is in position firmly to grip same.

17. A device according to claim 12 further comprissing means resiliently mounted in said support and extending into said recess and at least one formation on said shaft adapted to be engaged by said resiliently mounted means when said head is in position in said support.

18. A device according to claim 10 further comprising a second head, said second head having like characteristics. to said first head.

* * * * *